US006073274A

United States Patent [19]

McQueen

[11] Patent Number: 6,073,274

[45] Date of Patent: Jun. 13, 2000

[54] SANITARY TOILET SEAT COVER

[76] Inventor: Sherice Michelle McQueen, 36 Devon Dr., East Brunswick, N.J. 08816

[21] Appl. No.: 09/435,427

[22] Filed: Nov. 8, 1999

[51] Int. Cl.[7] ..... A47K 13/24; A47K 13/02; A47K 13/14

[52] U.S. Cl. ..... 4/245.4; 4/245.7; 4/245.1

[58] Field of Search ..... 4/245.1–245.9

[56] References Cited

U.S. PATENT DOCUMENTS

| | | | |
|---|---|---|---|
| 538,795 | 5/1895 | Saponoff | 4/245.7 |
| 1,745,223 | 1/1930 | Light . | |
| 2,313,311 | 3/1943 | Arter, Jr. et al. | 4/243 |
| 4,850,061 | 7/1989 | Engel | 4/243 |
| 4,881,278 | 11/1989 | Farah | 4/245.1 |
| 4,887,321 | 12/1989 | MacLean | 4/243 |
| 4,908,262 | 3/1990 | Nelson | 428/283 |
| 4,979,237 | 12/1990 | Hazar et al. | 4/245.4 |
| 4,998,297 | 3/1991 | Summerville | 4/245.7 |

FOREIGN PATENT DOCUMENTS

| | | | |
|---|---|---|---|
| 2620326 | 3/1989 | France | 4/245.1 |
| 2504494 | 8/1976 | Germany | 4/245.4 |

*Primary Examiner*—Henry J. Recla
*Assistant Examiner*—Tuan Nguyen
*Attorney, Agent, or Firm*—Henderson & Sturm LLP

[57] ABSTRACT

A sanitary toilet seat cover 10 for preventing direct contact between a person's skin and the top surface of a toilet seat 101. The toilet seat cover 10 includes a top layer 20 of waterproof material whose underside is affixed to a layer of porous material 40 impregnated with an antibacterial solution. The porous layer 40 is provided with a plurality of adhesive patches 51 to temporarily affix the seat cover 10 to a toilet seat 101 and a bottom layer 30 of waterproof material 31 whose peripheral edges are sealingly engaged with the underside of the top layer 20 of waterproof material 21 to provide an airtight envelope that surrounds the antibacterial solution until the toilet seat cover 10 is ready for use.

8 Claims, 1 Drawing Sheet

SANITARY TOILET SEAT COVER

BACKGROUND OF THE INVENTION

1. Field of the Invention

The present invention relates to the field of sanitary toilet seat covers in general, and in particular to an adhesively secured toilet seat cover having an anti-bacterial layer and a waterproof layer.

2. Description of Related Art

As can be seen by reference to the following U.S. Pat. Nos. 1,745,223; 2,313,311; 4,850,061; 4,887,321; and 4,980,262, the prior art is replete with myriad and diverse sanitary toilet seat covers that are designed to prevent direct contact between a person's skin and the toilet seat.

While all of the aforementioned prior art constructions are more than adequate for the basic purpose and function for which they have been specifically designed, they are uniformly deficient with respect to their failure to provide a simple, efficient, and practical sanitary toilet seat cover which has an antibacterial layer to kill germs on the toilet seat, a waterproof layer to prevent contact of the antibacterial liquid with the user's skin, and an adhesive securing means for temporarily immobilizing the toilet set cover on top of the toilet seat.

As anyone who has used the prior art toilet seat covers is all too well aware, none of these prior art constructions offer a great deal of either physical protection or mental comfort during their use due to inherent deficiencies in their design and construction.

As a consequence of the foregoing situation, there has existed a longstanding need for a new and improved sanitary toilet seat construction that not only is easy to install and remove, but which contains safety features that insure both the physical and mental well being of the user, and the provision of such a construction is a stated objective of the present invention.

BRIEF SUMMARY OF THE INVENTION

Briefly stated, the sanitary toilet seat construction that forms the basis of the present invention comprises in general, a waterproof top cover unit, an antibacterial unit, a temporary securing unit, and a bottom cover unit which cooperates with the top cover unit to form a sealed enclosure that will prevent deterioration of the germ killing properties of the antibacterial unit.

As will be explained in greater detail further on in the specification, both the top and bottom cover units comprise relatively thin waterproof panels of plastic material configured to overlay the top of a toilet seat. The peripheral edges of the cover units are sealed together to form an air tight waterproof envelope that surrounds the antibacterial unit.

In addition, the antibacterial unit comprises a thin layer of porous material such as paper or the like which is impregnated with an antibacterial solution which will kill germs when the liquid comes into contact with the germs on the top of the toilet seat. The user's weight on top of the top cover unit will assist in expressing the liquid from the porous paper.

Furthermore, the temporary securing unit comprises a plurality of adhesive securing members that are disposed at spaced locations around the bottom surface of the layer of paper that contains the antibacterial solution such that the top cover unit and the antibacterial unit may be temporarily immobilized relative to the top surface of the toilet seat.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 2:
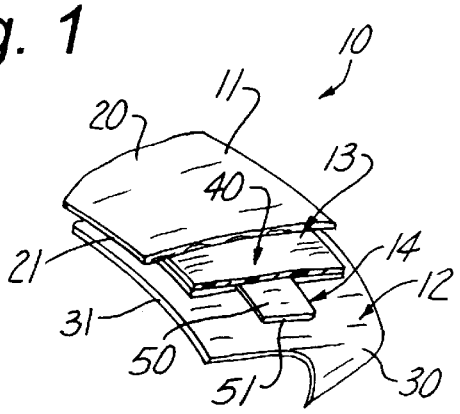
FIG. 2 is a perspective view of the components that comprise the toilet seat cover.

As can be seen by reference to the drawings, and in particular to FIG. 2, the sanitary toilet seat cover that forms the basis of the present invention is designated generally by the reference number 10. The toilet seat cover 10 comprises in general a top cover unit 11, a bottom cover unit 12, an antibacterial unit 13, and a temporary securing unit 14. These units will now be described in seriatim fashion.

Figure 1:
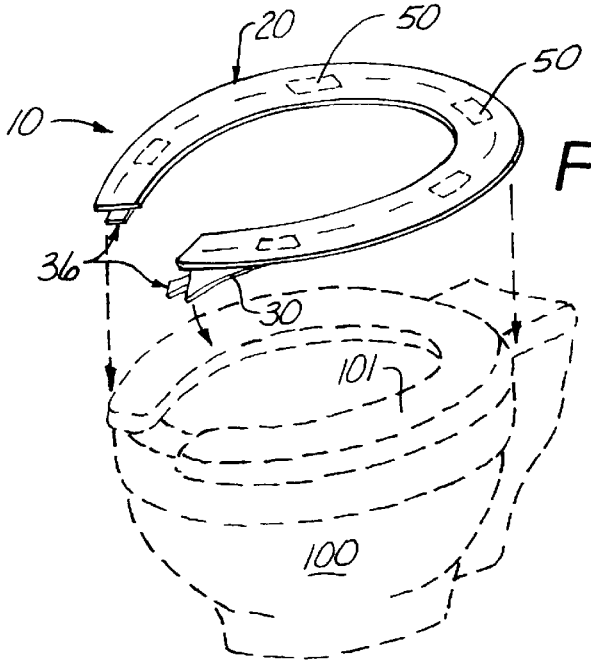
FIG. 1 is n exploded perspective view of the sanitary toilet seat cover in use.

As can be seen by reference to FIGS. 1 and 2, the top cover unit 11 comprises a first layer 20 of thin plastic material 21 which is contoured to cover the seat 101 of a conventional toilet 100 and the bottom cover unit 12 comprises a second layer 30 of thin plastic material 31 which is similarly contoured.

However, a shown in FIGS. 1, and 3 through 5, there are some slight variations between the configurations of the top 20 and bottom 30 layers of plastic. In the open mouthed seat configuration depicted in FIGS. 3 and 5, the bottom layer 30 is perforated as at 32 along its midline. In the closed mouth version depicted in FIG. 4, the bottom layer 30 is perforated as at 34 and 35 along the longitudinal axis of the configuration for reasons that will be explained presently.

Figure 3:
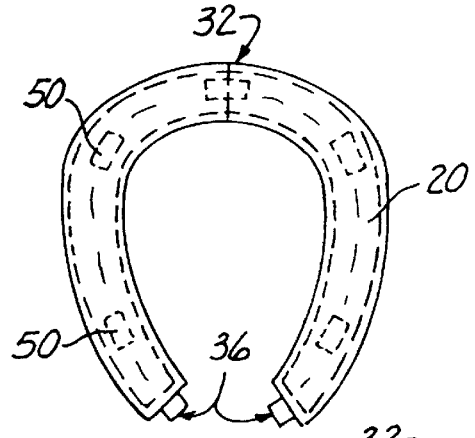
FIGS. 3 through 5 show different configurations for the toilet seat cover member to accommodate different shapes and styles of toilet seats.
Figure 4:
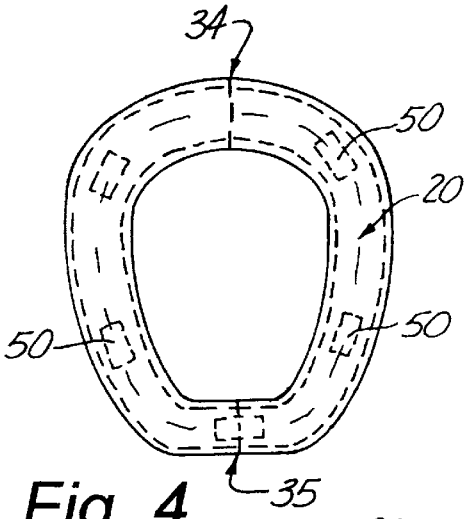

As shown in FIGS. 1 and 3, in the open mouthed residential version of this invention, the outboard ends of the removably bottom layer 30 are provided with tab elements 36 to facilitate the removal of the bottom layer 30 from the top layer 20. The peripheral edges of the bottom layer 30 have been sealingly engaged to the top layer 20 to form an air tight waterproof envelope as had been mentioned previously in the specification.

Figure 5:
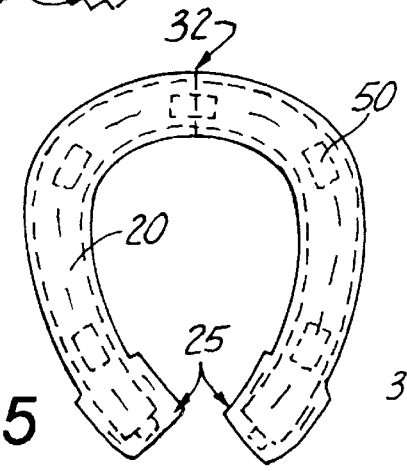

Turning now to FIG. 5, it can be seen that in the open mouthed commercial version of this invention, the outboard ends 25 of the top layer 20 are enlarged so as to substantially cover the opening of an open mouthed public toilet seat 101 for obvious sanitary reasons.

Returning once more to FIG. 2, it can be seen that the antibacterial unit 13 comprises a porous layer 40 fixedly secured to the underside of the top layer 20. The porous layer 40 is preferably fabricated from paper which is impregnated with an antibacterial solution which is protected from evaporation by being enclosed in the sealed envelope formed by the joined edges of bottom layer 30 with the top layer 20.

Still referring to FIG. 2, it can be seen that the securing unit 14 comprises a plurality of discrete immobilizing members 50 which in the preferred embodiment of the invention comprise adhesive patches 51 and in an alternate version of the preferred embodiment would comprise friction pads, or the like that would prevent the toilet seat cover 10 from slipping off the toilet seat 101 once the toilet seat cover 10 had been properly positioned with respect thereto.

Figure 6:
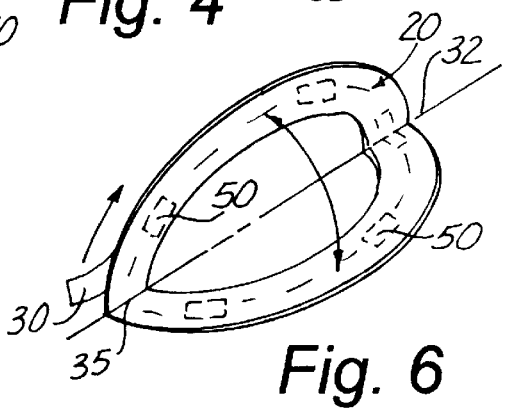
FIG. 6 is a perspective view depicting one method of installing the sanitary seat cover on a toilet seat.

In the preferred manner of usage illustrated in FIG. 6, it can be seen that the user would first fold the seat cover 10 about the perforated seams 34, 35 and position one side of the seat cover 10 on one side of a toilet seat 101. Then the user would remove the bottom layer 30 from the free side of seat cover 10 and engage the exposed adhesive patches 51 with the top surface of the toilet seat 101. This process would then be repeated with that portion of the top layer 20 that was still operatively engaged with the bottom layer 30.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A sanitary toilet seat cover to prevent direct contact between the surface of a person's skin and the top of a toilet seat wherein the seat cover comprises:

a top cover unit including a top layer of waterproof material configured to cover and conform to the top of a toilet seat;

an antibacterial unit including a layer of porous material affixed to the underside of said top layer and impregnated with an antibacterial solution;

means for temporarily immobilizing the top cover unit and the antibacterial unit relative to the top of a toilet seat; and bottom cover unit including a bottom layer of waterproof material having peripheral edges sealingly engaged with the top layer of waterproof material to captively surround the antibacterial unit in an airtight fashion; and means for rupturing the engagement between the top layer and bottom layer.

2. The sanitary toilet seat cover as in claim 1 wherein said means for temporarily immobilizing the top cover unit and the antibacterial unit relative to the top of the toilet seat includes a plurality of adhesive patches disposed at spaced locations on the antibacterial unit.

3. The sanitary toilet seat cover as in claim 1 wherein said means for temporarily immobilizing the top cover unit and the antibacterial unit relative to the top of the toilet seat includes a plurality of friction pads disposed at spaced locations on the antibacterial unit.

4. The sanitary toilet seat cover as in claim 1 wherein both the top and bottom layers of waterproof material are fabricated from thin plastic material.

5. The sanitary toilet seat cover as in claim 4 wherein the layer of porous material comprises paper.

6. The sanitary toilet seat cover as in claim 1 wherein the bottom layer of waterproof material is provided with at least one perforated seam.

7. The sanitary toilet seat cover as in claim 1 wherein the bottom layer of waterproof material is provided with at least one tab element to facilitate the separation of said bottom layer from said top layer.

8. The sanitary toilet seat cover as in claim 1 wherein said top layer is configured to cover an open mouthed toilet seat and the top layer has opposite ends which are enlarged to substantially cover the opening in the open mouthed toilet seat.

* * * * *